US008746454B2

(12) United States Patent
Doucet et al.

(10) Patent No.: US 8,746,454 B2
(45) Date of Patent: Jun. 10, 2014

(54) SECURE TABLET PACKAGE

(75) Inventors: Eric Doucet, Marcellaz Albanais (FR); Corinne Doucet, Marcellaz Albanais (FR)

(73) Assignee: A.C.D., Rumilly (FR)

( * ) Notice: Subject to any disclaimer, the term of this patent is extended or adjusted under 35 U.S.C. 154(b) by 1415 days.

(21) Appl. No.: 12/084,159

(22) PCT Filed: Oct. 18, 2006

(86) PCT No.: PCT/FR2006/002354

§ 371 (c)(1),
(2), (4) Date: Apr. 25, 2008

(87) PCT Pub. No.: WO2007/048906

PCT Pub. Date: May 3, 2007

(65) Prior Publication Data

US 2009/0038982 A1 Feb. 12, 2009

(30) Foreign Application Priority Data

Oct. 25, 2005 (FR) ..... 05 10884

(51) Int. Cl.
*B65D 83/04* (2006.01)

(52) U.S. Cl.
USPC ..... 206/531; 206/538

(58) Field of Classification Search
USPC ..... 206/531, 539, 538, 528, 1.5, 532, 468
See application file for complete search history.

(56) References Cited

U.S. PATENT DOCUMENTS

| | | | | |
|---|---|---|---|---|
| 3,324,996 | A | 6/1967 | Jordt | |
| 5,150,793 | A | 9/1992 | Tannenbaum | 206/531 |
| 6,338,408 | B1 * | 1/2002 | Anderson | 206/538 |
| 6,540,081 | B2 * | 4/2003 | Balz et al. | 206/531 |
| 6,675,972 | B2 * | 1/2004 | Patterson | 206/531 |
| 6,705,467 | B1 * | 3/2004 | Kancsar et al. | 206/531 |
| 6,832,686 | B2 * | 12/2004 | Donegan | 206/531 |
| 6,863,175 | B2 * | 3/2005 | Gelardi | 206/1.5 |
| 6,896,138 | B2 * | 5/2005 | Rock et al. | 206/531 |
| 6,988,618 | B2 * | 1/2006 | DeJonge | 206/528 |
| 6,997,320 | B1 * | 2/2006 | Kancsar et al. | 206/532 |
| 7,000,768 | B2 * | 2/2006 | Morita et al. | 206/531 |
| 2003/0183551 | A1 * | 10/2003 | Hulick | 206/531 |
| 2004/0079759 | A1 | 4/2004 | Harrold | 221/25 |
| 2005/0082194 | A1 | 4/2005 | Fry et al. | 206/531 |
| 2006/0138145 | A1 * | 6/2006 | Toth et al. | 220/345.2 |

FOREIGN PATENT DOCUMENTS

| | | | |
|---|---|---|---|
| DE | 101 17 910 | C1 | 8/2002 |
| WO | WO 2004/052749 | A1 | 6/2004 |

* cited by examiner

*Primary Examiner* — Anthony Stashick
*Assistant Examiner* — Ernesto Grano
(74) *Attorney, Agent, or Firm* — Fay Sharpe LLP

(57) ABSTRACT

A secure package (1) for drugs, blocks access to the drugs such that, to gain access to the drugs, the user must execute two simultaneous actions. When one of the actions is interrupted, access is rendered impossible. The secure package includes a case (2), a blister (3), and an elastic biasing system (4). The blister (3) is a cellular card pack for dispensing pills. The blister (3) is mobile and can be moved in translation in the case (2) by being slid on its base wall (16). Thus, the blister can take up two positions, namely an initial rest position, wherein the position of the cells (10) does not correspond to holes (19) formed in the base wall (16) and a so-called active position, wherein the cells (10) are in a position corresponding to the holes (19) in the base wall (16).

7 Claims, 5 Drawing Sheets

SECURE TABLET PACKAGE

The present invention relates to a secure package for tablets, and more particularly a cellular package for dispensing pills of the type including at least one blister, with a cover.

The danger of taking undesirable drugs is very important, especially for young children, who could be attracted by the sight of sometimes colored tablets which resemble candies. There is thus an unquestionable risk especially to children of taking drugs which are not intended for them, chiefly when the package is left unattended.

Cellular packages of blister type are very widespread, and the tablets under their transparent cells are particularly attractive for children, especially when to have access one has only to press on the tablet to break the cover.

Certain manufacturers have developed packages, for which the taking of the tablets is rendered difficult. Thus there are packages, for which two simultaneous actions are necessary to obtain a drug. Sometimes in spite of this genuine progress these packages are not completely satisfactory. In fact in the majority of cases, the packages once opened remain open.

One knows for example the package made public by international patent application published under number WO 2005/049438, according to which the user must make a double action for the opening, but once opened the case remains open and does not reclosed itself. It is also the case of the pill bottles, which to open it is necessary to push on the top and simultaneously to turn it.

The goal of the invention is that for the user to take a tablet, it for required for him to have to execute two simultaneous actions, such that the access to tablet is not possible as soon as one of the actions is not maintained.

Thus with the package of the invention the user must displace the blister in order to put into correspondence the blister cover with the hole of the case, and thus to push on the tablet to eject it. If the action on the blister is not maintained, this last by the action of a resilient system returns again to its initial position and this even if the user persists in exerting a force on the tablet, this last cannot be released because it is prevented by the bottom of the case.

Thus, the package of the invention is a secure package for drugs, which is characterized in that it includes means for restricting access to the drug such that to reach the drugs the user must carry out two simultaneous actions, such that as soon as one of the actions is interrupted the access is rendered impossible.

According to supplemental characteristics, the package includes a case, a blister and a resilient system, such that the blister is an cellular pill distribution package which includes a transparent covering defining at least one cell closed by a cover, in order to confine the medical tablet (12).

According to other supplementary characteristics, the case includes a part which one will call a box to which is articulated a section, forming a lid (6), and which includes two curbs, namely a first curb and a second curb, each curb extending transversely to define a guide for the blister, while the first curb defines an enclosure for holding the resilient system.

It will be noted that the wall defining the bottom of the case, includes at least one hole allowing the passage of the drugs when the blister is in its position giving access to the drugs.

Let us add that the blister includes at least a rigid lower sheet including openings destined to be aligned with the cells, in order to allow the passage of tablets after deformation of the corresponding cells and tearing of the cover.

According to other complementary characteristics, the blister is moveably mounted in the case, and can thus be displaced in translation in the case (2) and this by sliding motion on the bottom to assume two positions, namely an initial rest position, according to which the position of the cells (10) does not correspond to and a so-called active position, according to which the cells are in a position of correspondence with the holes of the bottom wall, such that the resilient system is configured to urge the blister in the direction of the second curb, and more particularly supported against its vertical wall.

Other characteristics and advantages of the invention will emerge from the description which will follow in view of the annexed drawings which are given only as non-limiting examples.

FIG. 4 is a top view of the blister of the package.

FIG. 5 is a cross-sectional view along A-A, of the blister of the package.

FIG. 6 is a bottom view of the blister of the package.

Figure 1:
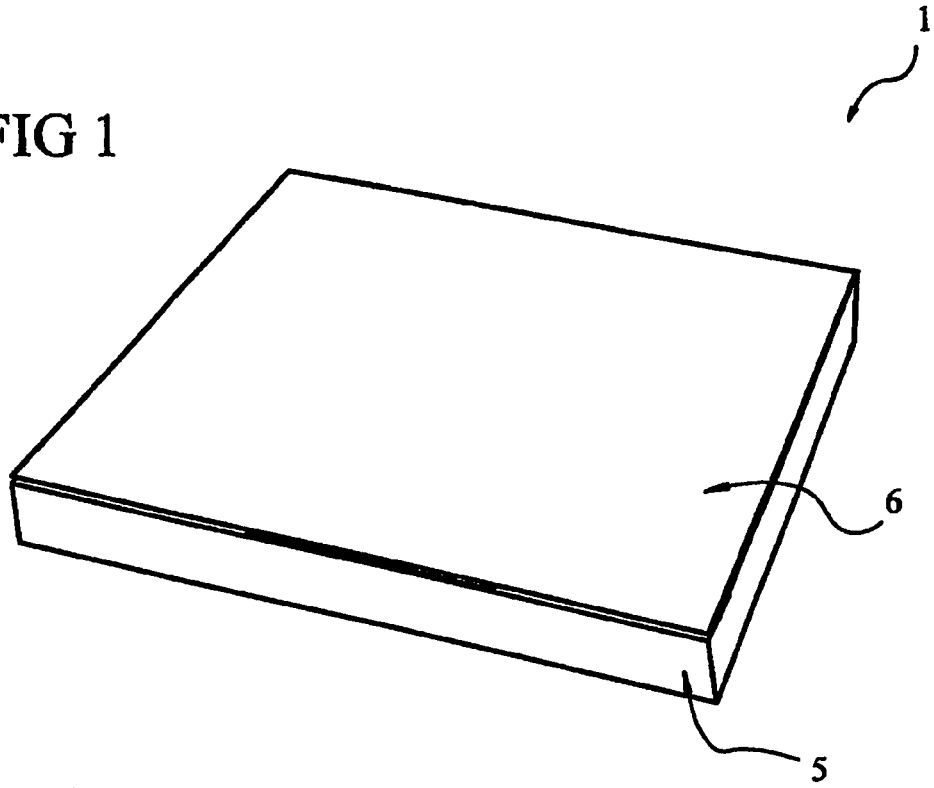
FIG. 1 is a perspective representation of the package in the closed position of non-utilization.
Figure 2:
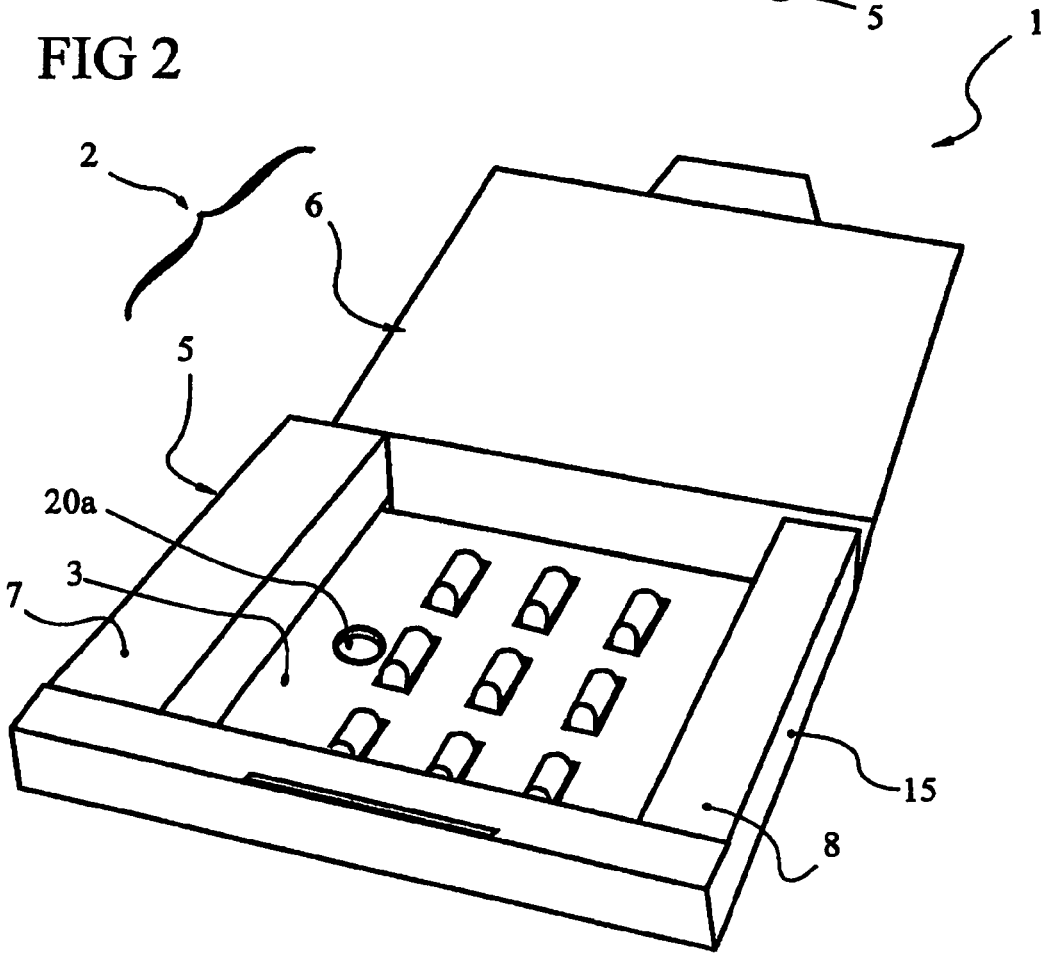
FIG. 2 is a perspective representation of the package in the open position.
Figure 3:
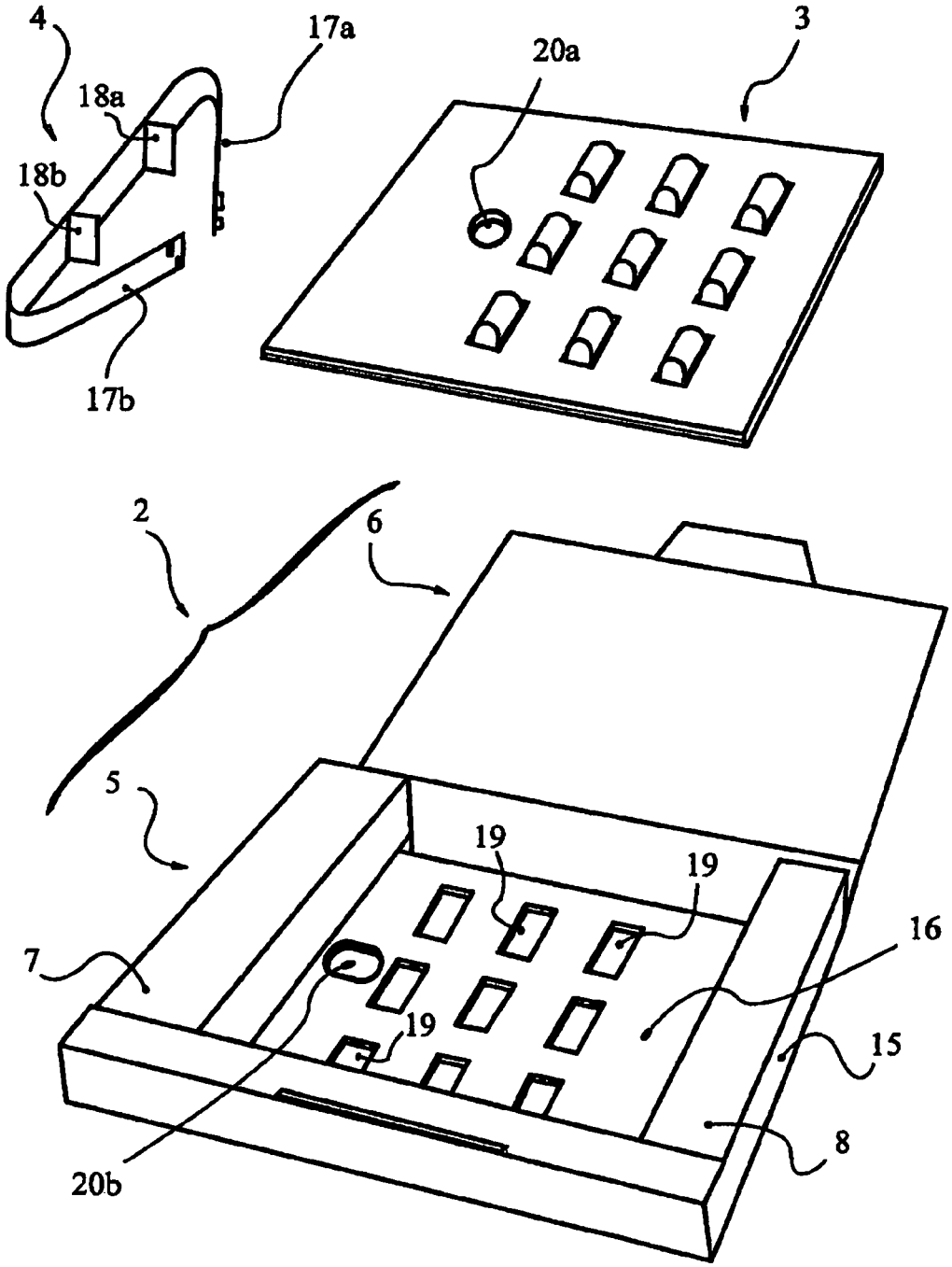
FIG. 3 is an expanded, prospective view representing various components of the package.
Figure 4:
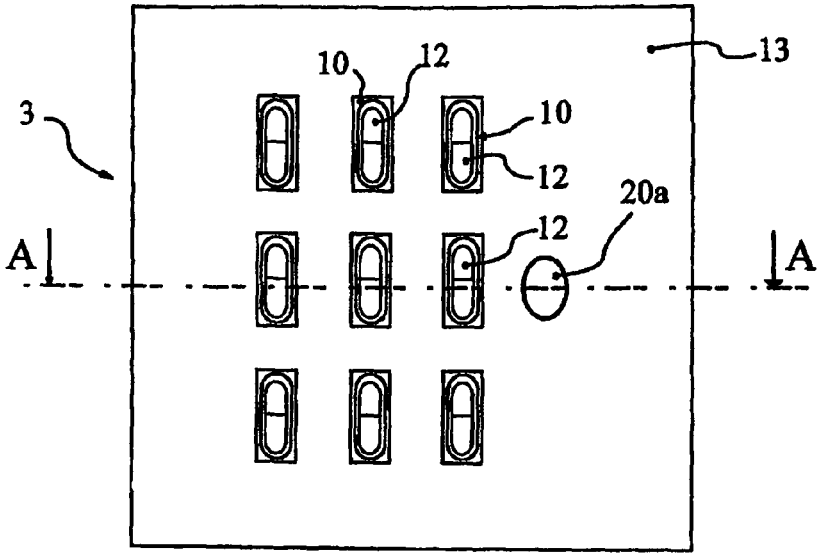
FIGS. 4, 5, 6 represent the blister of the package of the invention
Figure 5:
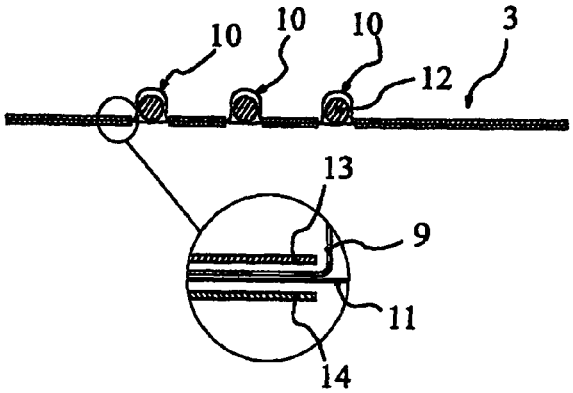
Figure 6:
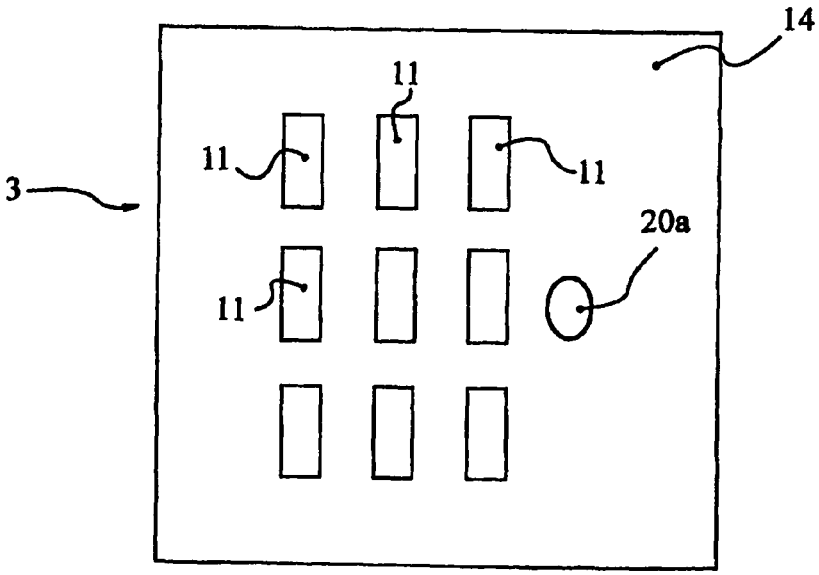

The package of the invention carrying the general reference (1) includes a case (2), a blister (3) and a resilient system (4).

The case (2) for example is made out of paperboard and includes a part which one will call a box (5) on which is an articulated section, forming a lid (6).

The case (5), includes two curbs (7, 8), namely a first curb (7) and a second curb (8), each curb extending transversely to form a guide for the blister, such that the first curb (7) constitutes an enclosure retaining the resilient system (4).

The blister (3) is a cellular card pack for the dispensing of pills. It is made of a transparent covering (9) defining at least a cell (10) closed by a cover (11), in order to imprison the medical tablet (12).

In the described exemplary embodiment the blister (3) is of the type whose transparent covering (9) includes several cells (10) and for example nine cells, namely three rows and three lines of cells.

The transparent covering for example is realized in a known way and in particular by thermoforming of a PVC sheet for example. It follows that the covering (9) could be not transparent, without leaving the framework of the invention.

According to the preferred embodiment of the invention the blister (3) in addition includes a rigid upper sheet (13) for example of paperboard, and a rigid lower sheet (14) for example of paperboard. Each sheet of paperboard includes openings corresponding to the cells. The openings of the upper sheet (13) allow the passage of the corresponding cells (10) of the transparent covering (9), while openings of the lower sheet (14) allow the passage of the tablets after deformation of the corresponding cells and tearing of the cover (11). Of course the blister could include only the lower sheet (14) without departing from the framework of the invention.

The resilient system (4) is intended to urge the blister (3) in the direction of the second curb (8), and more particularly supported against its vertical wall (15). The aforementioned resilient system can be of any type, but according to the embodiment given by way of example it made by a stirrup made of a thin plate made out of deformable plastic, whose two free branches (17*a*, 17*b*) are convergent. In addition it is envisaged a system of stops (18*a*, 18*b*) limiting resilient pivoting of the free branches (17*a*, 17*b*) thus allowing a perfect positioning of the blister, in the active position allowing the release of the tablets.

It will be noted that the wall forming the bottom (16) of the case, includes a succession of holes allowing the passage of tablets when the blister is in its position giving access to the tablets. Also let us note that the bottom wall (16) has a length (L1) longer than the length (L2) of the blister, and is such that the said length (L1) is equal to the length (L2) blister plus the length (L4), knowing that the length (L4) is slightly greater than the length (L3) which is the length of the resilient system in the compressed position.

Figure 7:
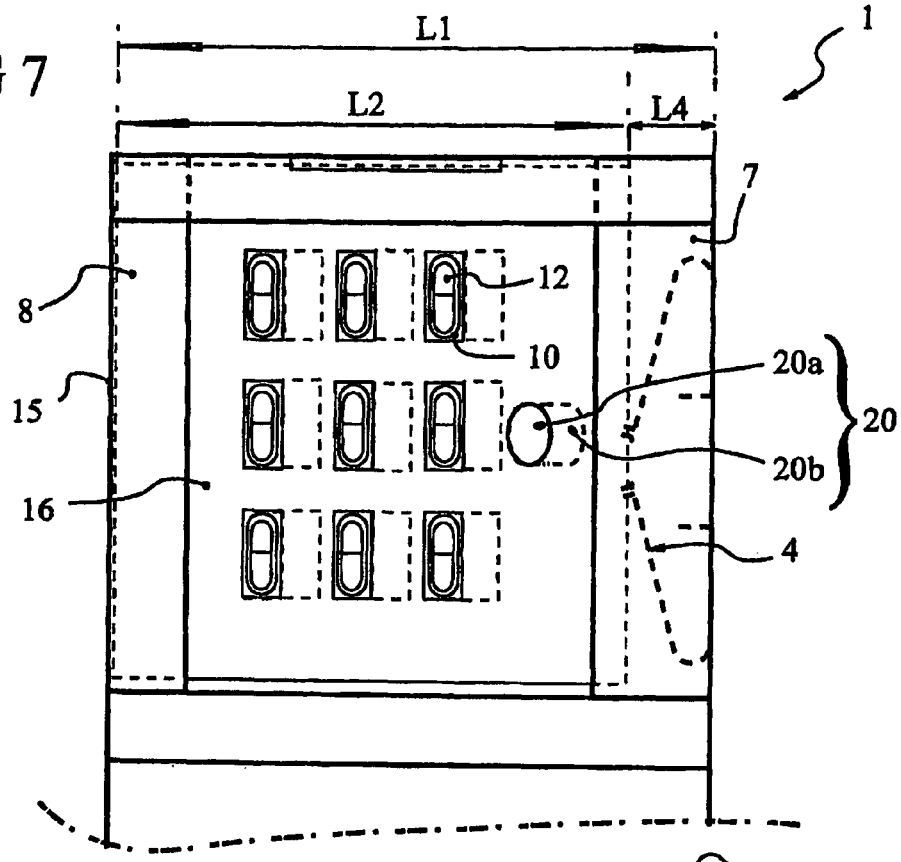
FIGS. 7 and 8 are plan views showing the package in its two positions, its initial steady-state position (FIG. 7), and it's activated position for dispensing the drug (FIG. 8).
Figure 8:
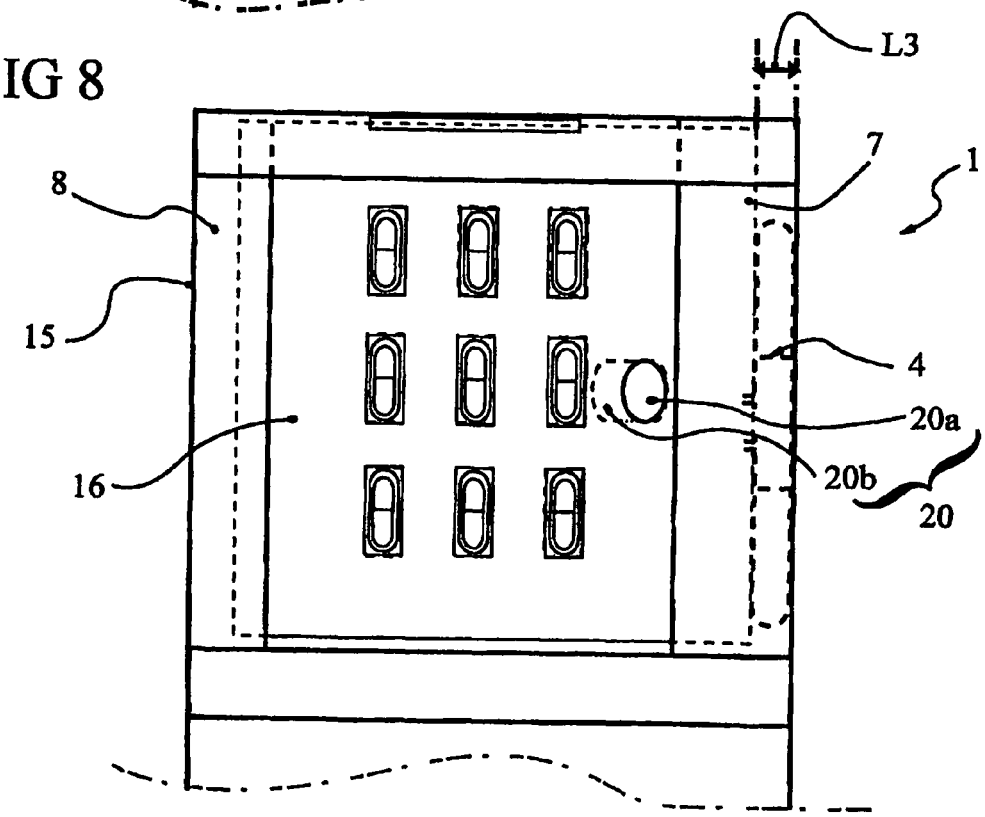
Figure 9:
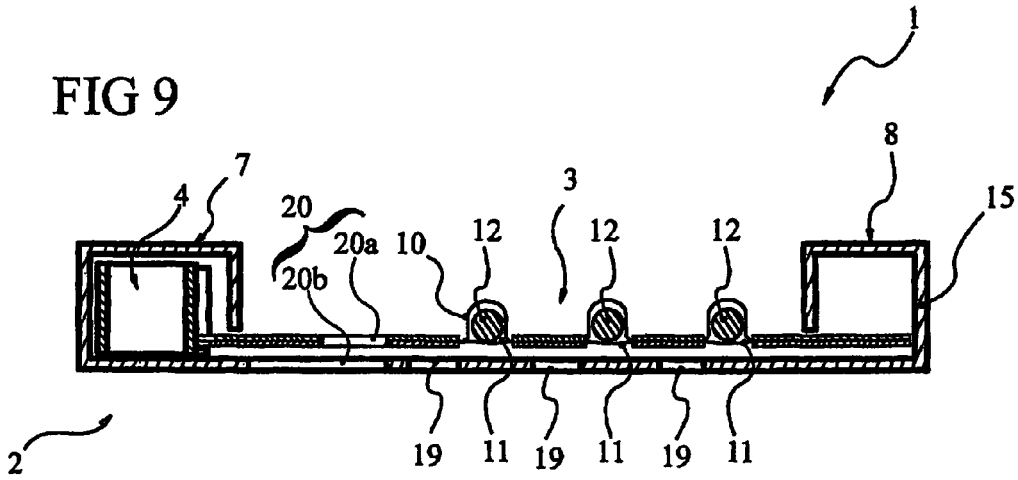
FIGS. 9, 10, 11, are cross-sectional views showing the package in its two positions, its initial steady-state position (FIG. 9), and its active position taking the drug (FIGS. 10 and 11).
Figure 10:
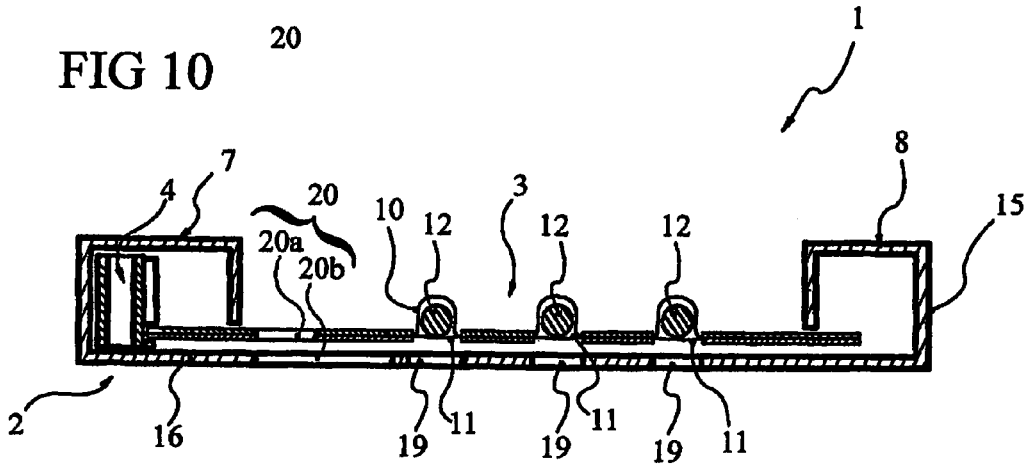
Figure 11:
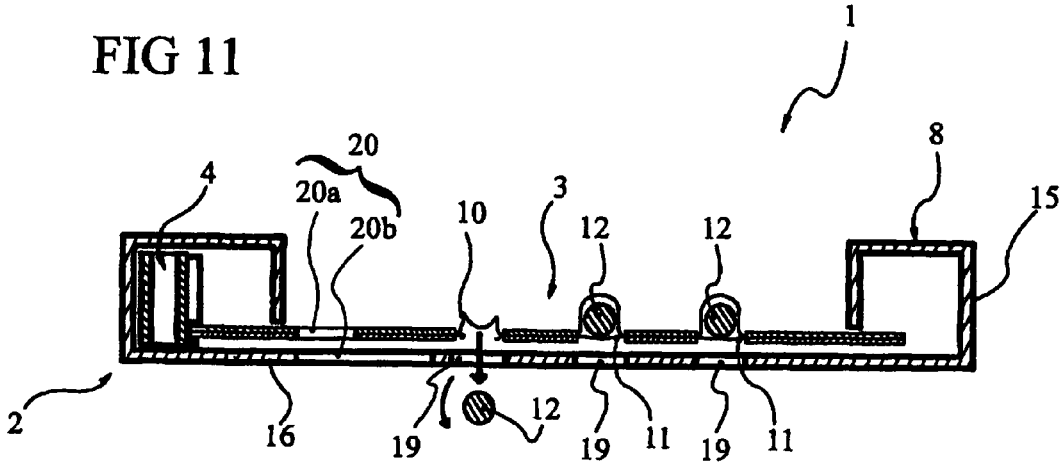

It was understood that the blister (3) is moveable and can be displaced in translation in the case (2) and this by sliding motion on the bottom (16). Thus, the blister can take two positions, namely an initial rest position such as illustrated in FIG. 7, according to which the position of the cells (10) does not correspond to the holes and a position known as active, such as illustrated on the FIGS. 8, 10 and 11, according to which the cells are a position in correspondence with the holes (19) of the bottom wall (16).

It was understood that with the package of the invention, to have access to the tablets, the user must displace the blister in order to put in correspondence the cover of the blister with the hole of the case, and to hold it in this position and simultaneously to push on the tablet to eject it. It will be noted that if the action on the blister is not maintained, this last by the action of an resilient system returns again to its initial position and of this even if the user persists in exerting an force on the tablet, this last cannot be released because prevented by the bottom of the case.

This type of package is thus very secure, because a child will have trouble understanding the process of access to the tablets and will not manage to undertake the two actions simultaneously.

The package according to the invention includes a gripping means (20) permitting the user to displace the blister. These means can be of any kind, such as for example a projection disposed on the top of the blister. These means can also be such that which is illustrated, namely, a hole (20*a*) defined in the wall of the blister and a corresponding oblong hole (20*b*) defined on the bottom wall (16) of the case.

As let us note that thanks to the package of the invention, that at the initial at-rest state position of the blister, the aluminum cover is not visible because hidden by the bottom wall of the case, even if the case is open.

Of course, the invention is not limited to the embodiments described and presented by way of examples, but it includes also all the technical equivalents as well as their combinations.

The invention claimed is:

1. The secure package for drugs comprising:

a case, a blister, and a resilient biasing system;

wherein the blister includes a cellular packing card for dispensing medicinal tablets;

wherein the blister includes a transparent covering defining at least a cell closed by a frangible cover, in order to imprison one of the medicinal tablets;

wherein the blister includes a grip permitting the user to displace the blister;

wherein the resilient biasing system is an independent element which is made by a stirrup made of deformable plastic;

wherein a wall defining a bottom of the case, includes at least one hole allowing dispensing of the tablets when the blister is in its position giving access to the tablets, such that to access the tablets the user must carry out two simultaneous actions, such that as soon as one of the actions is interrupted the access is rendered impossible; and wherein the blister includes at least a rigid lower sheet defining holes aligned with the cells of the blister and the frangible cover covering the holes, in order to allow the passage of the drugs after deformation of the corresponding cells and tearing of the frangible cover.

2. The secure package for drugs according to claim 1, wherein the grip includes a projection on a top of the blister.

3. The secure package for drugs according to claim 1, wherein the grip includes a hole defined in a wall of the blister and wherein the case has a corresponding oblong hole in the bottom wall of the case.

4. The secure package for drugs according to claim 1, wherein the case includes a box part and an articulated lid section.

5. The secure package for drugs according to claim 4, wherein the case includes two curbs, namely a first curb and a second curb, each curb extending transversely to define a guide for the cellular packaging card, the first curb defining an enclosure which retains the resilient biasing system.

6. The secure package for drugs according to claim 1, wherein the blister is moveably mounted in the case to be displaced in translation in the case by sliding motion on the bottom wall between two positions, namely an initial rest position in which at least one cell of the blister does not align with the at least one hole formed in the bottom wall and an active position in which the at least one cell is in alignment with the at least one hole in the bottom wall.

7. The secure package for drugs according to claim 6, wherein the resilient biasing system is configured to urge the blister in a direction to be supported against a vertical wall of the case.

* * * * *